United States Patent [19]

Falkinger

[11] 4,207,043

[45] Jun. 10, 1980

[54] APPARATUS FOR PRODUCING FIBERBOARD ACCORDING TO THE DRY METHOD

[75] Inventor: Willard Falkinger, Farsta, Sweden

[73] Assignee: Defibrator Fiberboard AB, Stockholm, Sweden

[21] Appl. No.: 809,076

[22] Filed: Jun. 22, 1977

[30] Foreign Application Priority Data

Jul. 5, 1976 [SE] Sweden ..... 7607693

[51] Int. Cl.[2] ..... B30B 5/06

[52] U.S. Cl. ..... 425/85; 425/372

[58] Field of Search ..... 425/80.1-83.1, 425/223, 224, DIG. 201, 371

[56] References Cited

U.S. PATENT DOCUMENTS

| | | | |
|---|---|---|---|
| 2,331,145 | 10/1943 | Slayter | 425/83.1 X |
| 2,697,254 | 12/1954 | Gordon | 425/82.1 X |
| 2,975,470 | 3/1961 | Snelson et al. | 425/85 |
| 3,025,197 | 3/1962 | Sheidby | 425/82.1 X |
| 3,051,219 | 8/1962 | Kaiser | 425/80.1 |
| 3,782,875 | 1/1974 | Alschewski | 425/223 |

FOREIGN PATENT DOCUMENTS

| | | | |
|---|---|---|---|
| 220466 | 3/1962 | Austria | 425/83.1 |

*Primary Examiner*—John McQuade
*Attorney, Agent, or Firm*—Eric Y. Munson

[57] ABSTRACT

Apparatus for producing fiberboard and the like from fibrous sheeting material by the dry method, in which the fibrous sheeting material is advanced from a forming station while supported on a perforated endless belt to a pressing station where it is compressed to desired thickness and compactness. During the advancement of the sheeting material from the forming station to the pressing station, air is evacuated from the fibrous material by suction from beneath the endless belt while the sheeting is being simultaneously subjected to a preliminary compression, without disturbing the fiber orientation therein, but sufficient to render the sheeting material self-supporting during its further advancement to the pressing station, from which it is passed to cutting station for subdivision into board units.

9 Claims, 2 Drawing Figures

APPARATUS FOR PRODUCING FIBERBOARD ACCORDING TO THE DRY METHOD

BACKGROUND OF THE INVENTION

This invention relates to apparatus for producing fiberboard for manufacture according to the dry method in which a a continuous sheet is formed from cellulosic fibers or shavings and thereupon compacted and subdivided into board units which are subjected to a pressure and heat treatment.

In manufacture of sheet or board units or similar products by known methods and apparatus as referred to herein, air is evacuated from the continuous fiber sheeting during a compression step immediately following the forming step. The compression is effectuated by various types of belt or strap presses and the air is evacuated by being forced out of the fiber sheeting laterally in the belt or strap press.

The resultant high velocity air flow transversely to the direction of a movement of the sheeting disturbs the orientation of the fibers in the fiber sheeting. As the fiber sheeting before it is compressed and has acquired sufficient stability must be carried by a wire cloth or similar support means the latter means must also be passed through the belt press with consequent risk of damage that may be caused by the high linear pressure and point pressure exerted by the press.

In the method of producing of sheet and board units described above it is also of greatest importance to maintain a high speed rate of feed in order to produce the greatest possible number of board units per unit of time. In the known methods and apparatuses referred to above for compressing and evacuating air from the continuous fiber sheeting directly after the forming step when high a rate of feed speed is required, the air removal from the fiber sheeting constitutes a capacity limiting factor unless the air can be evacuated at a sufficiently rapid pace.

MAIN OBJECTS OF THE INVENTION

Therefore, one main object of the invention is to provide an apparatus which provide for rapid air removal from the continuous fiber sheeting without disturbing the orientation of the fibers in the sheeting.

A further object of the invention is to provide a method and an apparatus which at the same time minimizes the risk of damage to the equipment.

A still further object of the invention is to provide an apparatus which provides for increased feed speed and consequent production of a greater number of sheet or board units per unit of time than with known methods and apparatus.

SUMMARY OF THE INVENTION

These objects are essentially achieved by evacuating the air mainly by means of vacuum. The air removal is effected prior to the compression preferably in connection with a slight pre-compression of the fiber sheeting.

Other objects, advantages and characterizing features of the invention will become apparent from the following description of a preferred embodiment in connection with the accompanying drawings which form part of this specification and of which:

THE DRAWINGS

DETAILED DESCRIPTION OF THE PREFERRED EMBODIMENT

Figure 1:
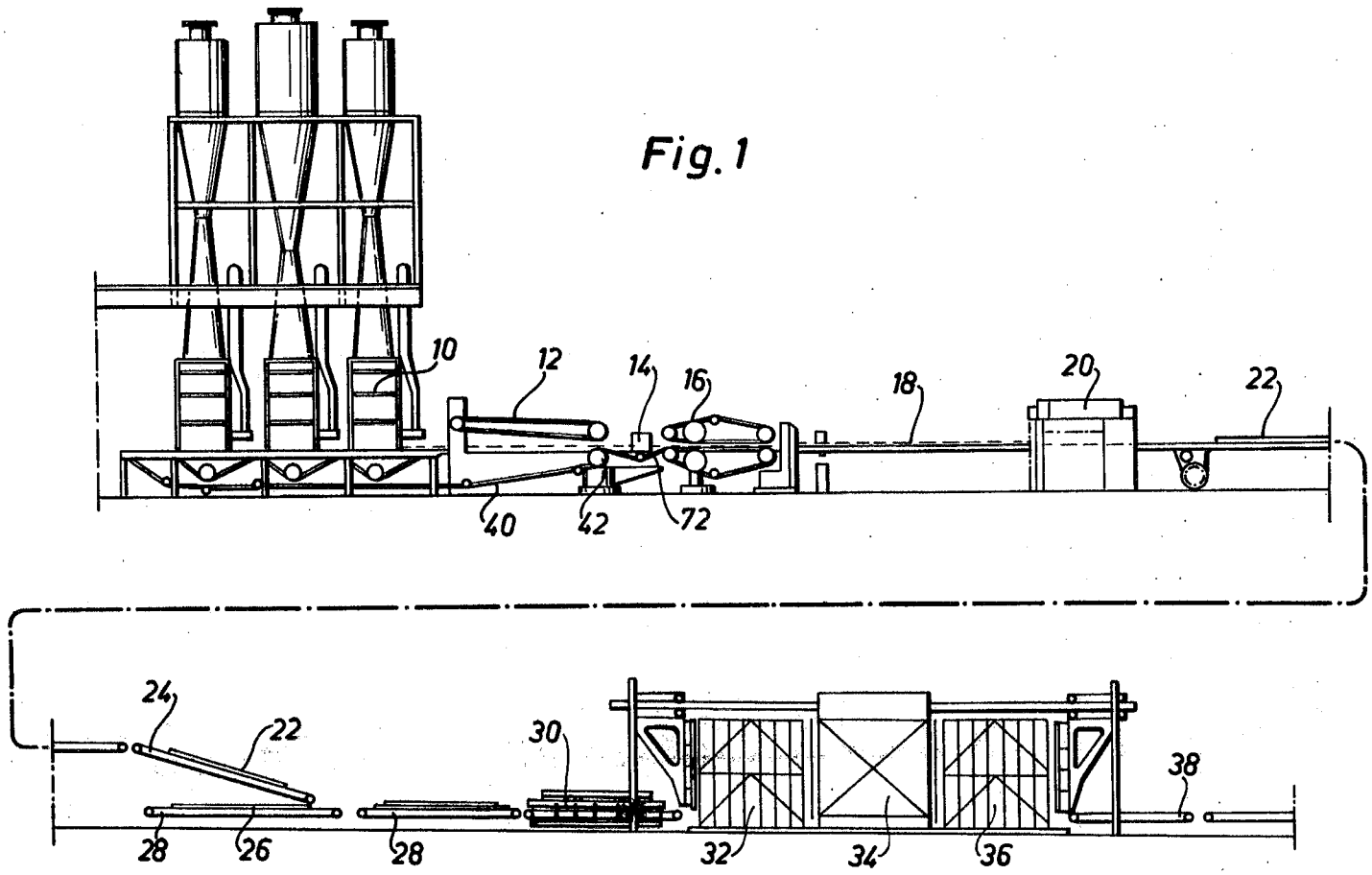
FIG. 1 is a schematic view showing the sequential steps in production. The upper portion of the Figure shows the steps from the station for forming the fiber sheeting to the station for cutting it into individual board or slab units and the lower portion shows how the the individual units are further compressed and stacked according to the conventional procedure.

Referring to the drawings, FIG. 1 shows the upper portion of a forming station 10 for forming a continuous fiber sheeting which is advanced from the forming station 10 to the right in the Figure. Positioned after the forming station is the novel apparatus 12 shown more detailed in FIG. 2 for air removal from, and pre-compression of, the fiber sheeting before the latter is passed into a belt or strap press 16 via metal detector 14. From the press 16, the compressed fiber sheeting 18 is conveyed on a conveyor belt not denoted nearer to the cutter machine 20 where the fiber sheeting is divided up into individual sheet or board units 22.

Referring to the lower portion of FIG. 1, which is not part of the invention the individual units 22 are conveyed further to a sloping upper conveyor track 24 and are deposited on corresponding plane conveyor plates 26 which are fed individually on a lower conveyor track 28 running below the upper conveyor track 24. The lower conveyor track 28 advances the conveyor plate 26 and the sheet 22 lying thereon to a piling device 30. The arrangement with the conveyors 24, 28 and the piling device 30 are disclosed in the co-pending U.S. Pat. application Ser. No. 623,534 now U.S. Pat. No. 4,042,125 to which reference is made for a more detailed description. From the piling device 30 in which the conveyor plates 26 with the board units 22 are piled one upon the other so that at least two plates 26 are included in each pile, the conveyor plates 26 are guided to an elevator member 32 known per se and in which the piles are stacked at different levels which correspond to the interspaces of a subsequent multiple opening press 34, to which the piles are transferred from the elevator member 32. From the multiple opening press 34 the plates 26 with the compressed board or slab units are conducted to still an elevator member 36 to which is of the same kind as the first mentioned one. Here the plate piles are fed into floors of the elevator member 36 corresponding to the press interspaced whereupon the plates with the board or slab units are discharged onto the conveyor track 38 for further transport and separation.

Figure 2:
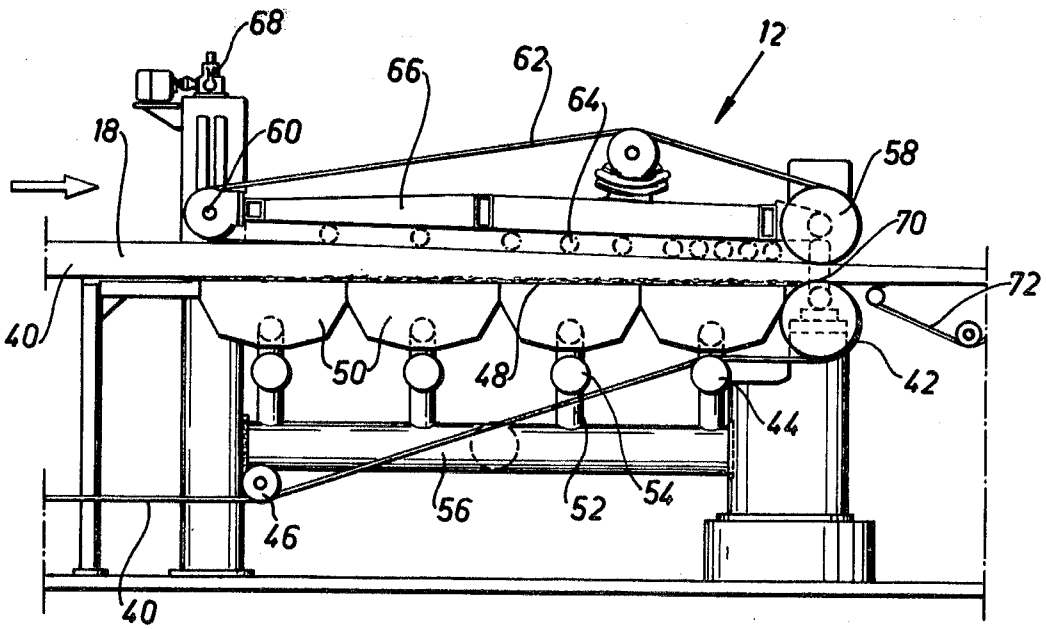
FIG. 2 is a schematic view of a preferred apparatus according to the invention.

As already mentioned herein, the apparatus 12 according to the invention is interposed between the forming station 10 and the conventional belt press 16 for compressing the fiber sheeting before it is divided by the cutting machine 20 into individual board or slab units, and which apparatus is shown in greater detail in FIG. 2. The entering fiber sheeting 18 is conveyed on an air-permeable belt 40, of e.g. wire cloth, which from the forming station 10 is advanced into the apparatus 12 and back to the forming station 10 over rolls 42, 44, 46 (see also FIG. 1). In the apparatus 12 the wire cloth runs over a perforated plate 48 which is disposed above and covers a plurality of vacuum boxes 50 so that the air present in the fiber sheeting 18 can be evacuated through the belt 40 and the plate 48 by means of the vacuum boxes 50. The vacuum boxes 50 are connected to a common collecting tube 56 by means of pipes 52 and valve 54. In this way the vacuum in each box 50 can be controlled individually by means of the valves 54. Mounted in the apparatus 12 above the fiber sheeting 18 is a belt or strap 62 circulating over rollers 58, 60. The rollers 58, 60 are together with a plurality of backing rollers 64 mounted in a frame 66 which in turn is mounted in the frame of the apparatus 12. The mounting is adjustable in vertical direction at the lefthand side of the drawing by means of a servomotor 68 with gear so that the respective end of the belt frame 66 can be raised and lowered to desired level. At the opposite end, the roller 58 is mounted for vertical adjustment, e.g. by means of a servomotor 70 so that this end of the belt also can be raised or lowered. By operation of the servomotors 68 and 70 the inlet and outlet openings of the space formed between the belt 62 and the wire cloth 40 can be varied in magnitude and set to a predetermined degree of pre-compression for a preliminary compression of the fiber sheeting 18 before it enters the subsequent belt press 16. The pressure in the pre-compression and air removal apparatus 12 is adjusted so as to protect the wire cloth 40 against damage. The belt 62 is preferably of rubber or plastic and consists of a homogenous belting which can be driven by the same motor or driving aggregate as the wire cloth 40. The cylinder or roller 58 of the upper belt is preferably driven by the motor driving the lower cylinder or roller 42 with a speed which is adjustable and variable relatively to the speed of the lower cylinder in response to the slope of the belt 62 towards the support. The drive connection is suitably designed so as to automatically adjust the number of revolutions of the upper cylinder 58 to the number of revolutions of the underlying cylinder 42 when the slope of the belt towards the wire cloth 40 is varied.

It will be apparent from the preceding description that the apparatus 12 will achieve an air removal and desired pre-compression of the fiber sheeting 18 without disturbing the orientation of the fibers thereof since the air to be removed is sucked downwards through the vacuum boxes 50. Thus the fiber sheeting 18 is pre-compressed to such an extent that the sheeting 18 can be conveyed further without being supported by wire cloth 40 which support means instead can be returned from the apparatus 12 to the forming station 10 without having to pass through the belt press 16 which spares the cloth 40. Due to the fact that the fiber sheeting 18 is pre-compressed and evacuated of air ahead of the belt press 16, it is also possible to provide a metal detector 14 between the apparatus 12 and the belt press 16 which prevents metallic articles from penetrating into the belt press 16 and damage the same. In previously known apparatus the thickness of the non-compressed fiber sheeting does not permit such an arrangement. The fiber sheeting 18 is conveyed from the air removal apparatus 12 to the belt press 16 past the detector 14 by means of The conveyor belt 72.

While one more or less specific embodiment of the invention has been shown and described, it should be understood that the invention may find a variety of expressions within the scope of the appended claims.

What is claimed is:

1. In an apparatus for producing fiberboard and the like from fibrous sheeting material by the dry method in which the fibrous sheeting material is continuously advanced from a forming station while supported on a perforated endless belt to a pressing station where it is compressed to desired thickness and compactness preliminary to being further advanced to a cutting station for subdivision into board units, the improvement comprising:

(a) an air evacuation station located between said forming station and said pressing station;

(b) suction means located beneath said endless perforated belt for evacuating air from said fibrous sheeting material; and (c) compression means in said air evacuating station effective to preliminarily compress said fibrous sheeting material simultaneously with the air evacuation therefrom by said suction means without disturbing the fiber orientation therein but sufficient to render it self-supporting while being advanced to said pressing station.

2. Apparatus according to claim 1, in which said suction means comprises a plurality of vacuum boxes arranged in sequence along the line of travel of said endless belt, each box being connected to a common vacuum source for individual power adjustment.

3. Apparatus according to claim 1, in which said compression means comprises an endless belt travelling between a set of transverse rollers above said fibrous sheeting material.

4. Apparatus according to claim 3, in which said rollers are individually adjustable to incline the compression means endless belt relative to said sheeting material.

5. Apparatus according to claim 4, comprising servomotor means for adjusting said rollers.

6. Apparatus according to claim 1, in which said endless belt is driven by a roller (42) located at the exit end for the sheet material of said air-evacuation station.

7. Apparatus according to claims 3, in which said compression means endless belt is driven by an upper roller (58) located above a lower roller (42) which drives said perforated endless belt, said lower and upper rollers (42, 58) being driven by a common driving source.

8. Apparatus according to claim 7, in which said lower and upper rollers (42 and 58) are operatively interconnected so that the rotational speed of the upper roller (58) can be varied with respect to the lower roller (42) and that a rotational speed differential is maintained during variations in the rotational speed of roller (42).

9. Apparatus according to claim 1, comprising a metal detector located between the air-evacuation station and the pressure station.

* * * * *